US005093032A

United States Patent [19]

Reid et al.

[11] Patent Number: 5,093,032

[45] Date of Patent: Mar. 3, 1992

[54] USE OF BORON CONTAINING COMPOUNDS AND DIHYDROXYBENZENES TO REDUCE COKING IN COKER FURNACES

[75] Inventors: Dwight K. Reid, Houston; Daniel E. Fields, The Woodlands, both of Tex.

[73] Assignee: Betz Laboratories, Inc., Trevose, Pa.

[21] Appl. No.: 682,503

[22] Filed: Apr. 8, 1991

Related U.S. Application Data

[62] Division of Ser. No. 637,094, Jan. 3, 1991, Pat. No. 5,039,391.

[51] Int. Cl.[5] ..... C10G 9/16

[52] U.S. Cl. ..... 252/400.4; 252/400.41; 252/407

[58] Field of Search ..... 252/400.4, 400.41, 407

[56] References Cited

U.S. PATENT DOCUMENTS

| | | | |
|---|---|---|---|
| 1,847,095 | 3/1932 | Mittasch et al. | 208/48 |
| 2,063,596 | 12/1936 | Feiler | 196/133 |
| 3,342,723 | 9/1967 | Godar | 208/48 |
| 3,531,394 | 9/1970 | Koszman | 208/48 |
| 3,661,820 | 5/1972 | Foreman et al. | 260/22 A |
| 3,687,840 | 8/1972 | Sze et al. | 208/131 |
| 4,131,557 | 1/1979 | Saylor | 251/108 X |
| 4,175,964 | 11/1979 | Uchida et al. | 430/306 |
| 4,258,122 | 3/1981 | Uchida et al. | 430/302 |
| 4,328,304 | 5/1982 | Tachikawa et al. | 430/306 |
| 4,370,404 | 1/1983 | Tachikawa et al. | 430/302 |
| 4,555,326 | 11/1985 | Reid | 208/48 |
| 4,680,421 | 7/1987 | Forester et al. | 585/648 |
| 4,724,064 | 2/1988 | Reid | 108/48 |

FOREIGN PATENT DOCUMENTS

| | | | |
|---|---|---|---|
| 275662 | 8/1928 | United Kingdom | 208/48 |
| 296752 | 9/1928 | United Kingdom | 260/668 |

OTHER PUBLICATIONS

Chemical Abstracts: vol. 83:30687k, 1975.
Chemical Abstracts: vol. 87:154474r, 1977.
Chemical Abstracts: vol. 95:135651v, 1981.
Chemical Abstracts: vol. 92:8645j, 1980.

*Primary Examiner*—Deborah L. Kyle
*Assistant Examiner*—Valerie Fee
*Attorney, Agent, or Firm*—Alexander D. Ricci; Philip H. Von Neida

[57] ABSTRACT

The present disclosure is directed to a composition and methods for controlling undesirable coke formation and deposition commonly encountered during the high temperature processing of hydrocarbons. Coke formation can be inhibited by adding a sufficient amount of a combination of a boron compound and a dihydroxybenzene.

13 Claims, No Drawings

USE OF BORON CONTAINING COMPOUNDS AND DIHYDROXYBENZENES TO REDUCE COKING IN COKER FURNACES

This is a divisional of application Ser. No. 07/637,094 filed Jan. 3, 1991, now U.S. Pat. No. 5,039,391.

FIELD OF THE INVENTION

The present invention is directed to a composition and method of inhibiting the formation and deposition of coke in fluid transfer tubes in delayed coker systems. More specifically, the present invention is directed to a composition and method of inhibiting the formation and deposition of coke in fluid transfer tubes using a combination of a boron compound and a dihydroxybenzene compound or precursors thereof.

BACKGROUND OF THE INVENTION

The present invention is directed to a composition and method for inhibiting the formation and deposition of coke on fluid transfer tubes during the elevated temperature processing of hydro carbons. Delayed coking is used for converting any type of reduced crude to cracking feedstock. These systems operate at temperatures of 600° to 1300° F. Coke deposition occurs when hydrocarbon liquids and vapors contact the hot metal surfaces of the processing equipment.

Due to the complex makeup of the hydrocarbon and the elevated temperatures and the contact with hot metallic surfaces, it is not entirely understood just what is occurring during processing. It is thought that the hydrocarbons undergo various changes through either chemical reactions and/or decomposition of various unstable components of the hydrocarbon. The undesired bi-products produced include coke, polymerized products, deposited impurities and the like. Whatever the undesired product that may be formed, reduced economies of the process is the result. If these deposits remain unchecked, heat transfer, throughput and overall productivity are detrimentally effected. Moreover, downtime is likely to be encountered due to the necessity of either replacing and/or of cleaning the affected parts of the processing system.

Carbon formation also erodes the metal of the system in two ways. The formation of catalytic coke causes the metal catalyst particle to be dislodged. This results in metal loss and ultimately metal failure at a rapid pace. The other erosive effect occurs when carbon particles enter the hydrocarbon stream and act as abrasives on the systems tube walls.

While the formation and type of undesired products vary as to the hydrocarbon being processed and the conditions of the processing, it may generally be stated that such products can be produced at temperatures as low as 100° F. but are more prone to formation at the temperature of the processing system and the hydrocarbon fluid at levels of 600° to 1300° F. At these temperatures, coke formation is likely to occur, regardless of the type of hydrocarbon being charged.

One solution to this coking problem is achieved by lowering the reaction severity by means of lowering the reaction temperature. The downside to this method is the resultant decrease in product yield.

The present invention is particularly effective in hydrocarbon processing systems where temperatures reach levels of 600° to 1300° F. where amorphous and filamentous coke are likely to be formed. Amorphous coke is generally produced in systems that operate at temperatures less than 850° F. This type coke generally is composed of low molecular weight polymers, has no definite structure and is sooty in nature. Above 850° F., filamentous coke is generally encountered. This type coke, as the name indicates, takes the form of filaments that appear in some cases like hollow tubes. As opposed to amorphous coke, filamentous coke is not sooty and is hard and graphitic in nature.

Amorphous and filamentous coke formation is customarily found in hydrocarbon processing systems such as delayed coking (operating temperature 900° to 1300° F.); platforming, catalytic reforming and magna forming processes (900° F.); residue desulferization processes (500° to 800° F.); hydrocracking processes (800°-1000° F.); cracking of chlorinated hydrocarbons and other petrochemical intermediates at similar temperatures.

Pyrolytic coke is produced in olefin manufacture where pyrolysis of gaseous feed stocks (ethane, butane, propane, etc.) or liquid feed stocks (naphthas, kerosene, gas oil, etc.) are "cracked" by exposing such stocks to temperatures of from 1400° to 1700° F. to produce the desired olefin.

While various treatments have been proposed to eliminate or reduce filamentous coke formation at 600°-1300° F. temperatures, none have proven as efficacious as the present invention.

GENERAL DESCRIPTION OF THE INVENTION

The present invention relates to a composition and method for inhibiting the formation and deposition of coke in fluid transfer tubes in delayed coker systems using a combination of a boron compound and a dihydroxybenzene compound.

While the method is applicable to any system where coke is produced, the method is particularly effective in hydrocarbons having a temperature of 600°-1300° F. The method is also particularly effective when the surface of the fluid transfer tube is composed of a ferrous metal.

Accordingly, it is an object of the present invention to inhibit the formation and deposition of coke on fluid transfer tubes in a delayed coker process.

These and other objectives and advantages will be apparent from the specification.

DESCRIPTION OF THE RELATED ART

French Patent No. 2,202,930 (Chem. Abstracts Vol. 83:30687k) is directed to tubular furnace cracking of hydrocarbons where molten oxides or salts of Group III IV or VIII metals (e.g., molten lead containing a mixture of $K_3VO_4$, $SiO_2$ and NiO) are added to a pretested charge of, for example, naphtha steam at 932° F. This treatment is stated as having reduced deposit and coke formation in the cracking section of the furnace.

Starshov et al., Izv. Vyssh. Uchebn. Zaved Neft Gaz, 1977 (Chem. Abst. 87:154474r) describes the pyrolysis of hydrocarbons in the presence of aqueous solutions of boric acid. Carbon deposits were minimized by this process.

Nokonov et al., U.S.S.R. No. 834,107, 1981; (Chem. Abst. 95:13565v) describes the pyrolytic production of olefins with peroxides present in a reactor, the internal surfaces of which have been pretreated with an aqueous alcoholic solution of boric acid. Coke formation is not mentioned in this patent since the function of boric acid is to coat the inner surface of the reactor and thus decrease the scavenging of peroxide radicals by the reactor surface.

Starshov et al., Neftekhimiya 1979 (Chem. Abst. 92:8645j) describes the effect of certain elements including boron on coke formation during the pyrolysis of hydrocarbons to produce olefins.

U.S. Pat. No. 3,531,344 (Koszman) teaches the inhibition of carbon formation in the thermal cracking of petroleum fractions. His process teaches the use of bismuth and phosphorous containing compounds to reduce carbon formation.

U.S. Pat. No. 3,661,820 (Foreman et al.) teaches a composition that is used as a coating for steel surfaces. This composition will prevent carburization in gas carburizing, pack carburizing and carbonitriding mediums. The composition taught is a boron compound selected from boric acid, boric oxide and borax; water soluble organic resin; carrier fluid of water and thickening and drying agents.

U.S. Pat. No. 2,063,596 (Feiler) teaches a method of treating the metal of a system processing hydrocarbons at high temperatures. This patent discloses the suppression of the deposition of carbon on the metal surfaces of a hydrocarbon process using the metals tin, lead, molybdenum, tungsten and chromium to coat the metal surfaces. This patent conjectures as to the use of a metalloid of boron as a treating agent.

Great Britain 296,752 teaches a method of preventing deposition of coke or soot on metal surfaces in contact with hydrocarbons at high temperatures. The metals are treated directly with metalloids of boron, arsenic, bismuth, antimony, phosphorous or selenium.

Great Britain 275,662 teaches a process for preventing the formation of carbon monoxide in a hydrocarbon cracking operation. This process involves coating the metal surfaces that contact the hydrocarbon with metalloids of boron, arsenic, antimony, silicon, bismuth, phosphorous or selenium.

U.S. Pat. No. 1,847,095 (Mittasch et al.) teaches a process for preventing the formation and deposition of carbon and soot in hydrocarbon processes operating at elevated temperatures. This process consists of adding to the hydrocarbon stream hydrides of metalloids selected from the group of boron, arsenic, antimony, bismuth, phosphorous, selenium and silicon.

U.S. Pat. No. 3,687,840 (Sze et al.) teaches a method of stopping plugs in a delayed coker unit that result from the formation and deposition of coke. This process employs sulfur and sulfur compounds as the inhibiting agents.

U.S. Pat. No. 4,555,326 (Reid) teaches a method of inhibiting the formation and deposition of filamentous coke in hydrocarbon processing systems operating at high temperatures. The metal that contacts the hydrocarbon fluid is first treated ("boronized") by contacting it with boron, boron oxide compounds or metal borides.

U.S. Pat. No. 4,729,064 (Reid) teaches a method of inhibiting the formation and deposition of filamentous coke on metal surfaces in contact with a hydrocarbon fluid at high temperatures. Boron oxide compounds, metal borides and boric acid which is substantially free of water are the inhibiting agents.

U.S. Pat. No. 4,680,421 (Forester et al.) discloses a method of inhibiting the formation and deposition of pyrolytic coke on the heated metal surfaces of a pyrolysis furnace. This method employs an ammonium borate compound to inhibit the deposition on the 1600° F. and higher temperature metal surfaces.

U.S. Pat. No. 3,342,723 (Godar) teaches a method of inhibiting the formation and deposition of coke-like deposits and soft sludges on structural surfaces in contact with a hydrocarbon undergoing petroleum refining. The method utilizes an ortho substituted aromatic compound or substituted monocyclic compound such as catechol as the antifouling agent. This patent does not teach the synergistic composition of the present invention.

DETAILED DESCRIPTION OF THE INVENTION

The present invention relates to the use of a combination of a boron compound and a dihydroxybenzene compound to inhibit the formation and deposition of coke during the high temperature processing of hydrocarbons and in particular in fluid transfer tubes in a delayed coker system.

The present invention is more specifically directed to a composition and method for inhibiting the formation and deposition of coke on surfaces in contact with a hydrocarbon which comprises adding to said hydrocarbon a sufficient amount for the purpose of a combination of a boron compound and a dihydroxybenzene compound.

While the composition and method is applicable to any system where coke is produced, the method is particularly effective in hydrocarbons being processed at temperatures of 600°–1300° F. The hydrocarbon can be composed of crude oils, shale oil, athabasca bitumen, gilsonite, coal tar pitch, asphalt, aromatic stocks and refractory stocks. The method is also particularly effective when the surface of the fluid transfer tube is composed of a ferrous metal. Iron as well as iron alloys such as low and high carbon steel, and nickel-chromium-iron alloys are customarily used for the production of hydrocarbon processing equipment such as furnaces, transmission lines, reactors, heat exchangers, separation columns, fractionators and the like. As earlier indicated, and depending upon the process being practiced, certain alloys within a given system are prone to coke deposition and the consequences thereof.

The present inventors discovered that coking may be significantly reduced on the iron-based and nickel-based surfaces of processing equipment by adding to the hydrocarbon feed stock or charge ammonium biborate and hydroquinone.

The inventors anticipate that ammonium pentaborate, boron oxide, sodium tetraborate and boric acid will also be useful as the boron compound in the inventive composition.

The inventors also anticipate that 1,2-napthoquinone, 1,4-napthoquinone, catechol, 4-tert-butylcatechol, resorcinol and 4-tert-butylresorcinol will also be useful as the dihydroxybenzene compound in the inventive composition.

The treatment dosages are dependent on the severity of the coking problem, location of such problems and the amount of active boron compound and dihydroxybenzene compound in the formulated product. Perhaps the best method of describing the treatment dosage would be based upon the actual amount of boron compound and dihydroxybenzene compound that should be added to the hydrocarbon charge. Accordingly, a range of from about 1 to 600 ppm boron compound per million parts of hydrocarbon charge and a range of from about 1 to 250 ppm dihydroxybenzene compound per million parts of hydrocarbon charge are commonly used dosages.

The combined boron compound and dihydroxybenzene compound may be added to the desired system in a range expressed as percent composition of 0.2 to 99.6% boron compound and 99.8 to 0.4% dihydroxybenzene compound. The preferred range of addition is 37.5 to 70.6% for the boron compound and 62.5 to 29.4% for the dihydroxybenzene compound.

The preferred percent composition for the two components would be 62.5% hydroquinone and 37.5% ammonium biborate.

EXPERIMENTAL

The test data reported below was generated by using an intermediate temperature antifoulant apparatus. A cleaned coker rod is preweighed in grams and mounted into a cracking furnace where it is held in place by transfer lines. This furnace is then closed. Approximately 1.5 liters of a coker feedstock is introduced into a Parr reactor vessel. This reactor vessel is then closed and locked.

The coker feedstock is then heated to 400° F. and continuously agitated by way of a stirrer. Heating zones connecting the cracking furnace and Parr reactor vessel are maintained at temperatures of 400° F. and 620° F. respectively. The higher temperature heating zone is situated next to the cracking furnace.

The cracking furnace is then raised to a temperature of 1400° F. and is held at this temperature throughout the test. The coker feedstock is then carried to the cracking furnace, experiencing temperatures in excess of 1000° F. This cracked feedstock is then passed into the Parr reactor vessel where it is allowed to cool. The actual run lasts two hours. After the cracking furnace has cooled to room temperature, the coker rod is washed with xylene and then weighed in grams. This weight minus the initial clean weight is the amount of coke deposited.

Tables I, II and III report the results of the above test by indicating the amount of coke formed for various treatment dosages. Indicative of effective treatment is a low amount of coke formed.

TABLE I

| Coker feedstock obtained from a Southern California Refinery | | |
|---|---|---|
| Treatment | Dosage (ppm) | mg Coke Formed |
| Control | — | 68 |
| Control | — | 65 |
| Control | — | 65 |
| Hydroquinone (HQ) | 600 | 66 |
| Hydroquinone (HQ) | 600 | 73 |
| Ammonium Biborate | 600 | 60 |
| Ammonium Biborate | 350 | 67 |
| Ammonium Biborate | 250 | 44 |
| Ammonium Biborate | 150 | 67 |
| Ammonium Biborate/HQ | 250/150 | 16 |

TABLE II

| Coker feedstock obtained from a Southwest Texas Refinery | | |
|---|---|---|
| Treatment | Dosage (ppm) | mg Coke Formed |
| Control | — | 73 |
| Control | — | 69 |
| Ammonium Biborate/HQ | 250/600 | 28 |

TABLE III

| Coker feedstock obtained from a Northern California Refinery | | |
|---|---|---|
| Treatment | Dosage (ppm) | mg Coke Formed |
| Control | — | 60 |
| Control | — | 64 |
| HQ/Ammonium Biborate | 250/150 | 24 |

TABLE III-continued

| Coker feedstock obtained from a Northern California Refinery | | |
|---|---|---|
| Treatment | Dosage (ppm) | mg Coke Formed |
| HQ/Ammonium Biborate | 250/150 | 31 |

As Table I indicates, hydroquinone is not as effective as the inventive composition at controlling coke deposition. Ammonium biborate does demonstrate some efficacy when used by itself. Tables II and III show that a combination of hydroquinone and ammonium biborate were quite effective in reducing coke deposition as compared with the control runs.

FIELD TRIAL

A northwestern United States coker furnace charging 25,000 barrels per day (BPD) experienced severe tube fouling so that coil pressure drop limited furnace throughput and run lengths. Due to the rate of increase of coil inlet pressures, a steam air decoking was scheduled. In an attempt to postpone the unit shutdown, the refiner decided to evaluate antifoulant chemistry. A combination of a Betz Process Chemicals' product containing 35% by weight ammonium biborate tetrahydryde, and a Betz Process Chemicals' product containing 20% by weight hydroquinone was recommended. The boron containing product acts to inhibit the formation of catalytic coke which grows outward from the tube surface, while the other is a polymerization inhibitor which reduces macromolecule formation.

Through 92 days of operation, performance of the antifoulant program has been outstanding. Coil inlet pressures have been reduced from 0.54 psi/day and 0.20 psi/day to 0.00 psi/day and 0.12 psi/day for passes 1 and 2 respectively. Protection based on these values is 85% for pass 1 and 40% for pass 2. Due to this reduction in the rate of increase of furnace coil inlet pressures, the refiner was able to extend his run by approximately 6 months.

While this invention has been described with respect to particular embodiments thereof, it is apparent that numerous other forms and modifications of this invention will be obvious to those skilled in the art.

Having described the invention, we claim:

1. A hydrocarbon in which the formation and deposition of coke on surfaces in contact with the hydrocarbon is inhibited which comprises a hydrocarbon, 1 to 600 ppm of a boron compound per million parts of hydrocarbon and 1–250 ppm of a dihydroxybenzene compound per million parts of hydrocarbon.

2. A composition according to claim 1 wherein said boron compound is ammonium biborate.

3. A composition according to claim 1 wherein said boron compound is ammonium pentaborate.

4. A composition according to claim 1 wherein said boron compound is boron oxide.

5. A composition according to claim 1 wherein said boron compound is sodium tetraborate.

6. A composition according to claim 1 wherein said boron compound is boric acid.

7. A composition according to claim 12 wherein said dihydroxybenzene compound is hydroquinone.

8. A composition according to claim 1 wherein said dihydroxybenzene compound is 1,2-napthoquinone.

9. A composition according to claim 1 wherein said dihydroxybenzene compound is 1,4-napthoquinone.

10. A composition according to claim 1 wherein said dihydroxybenzene compound is catechol.

11. A composition according to claim 1 wherein said dihydroxybenzene compound is 4-tert-butyl catechol.

12. A composition according to claim 1 wherein said dihydroxybenzene compound is resorcinol.

13. A composition according to claim 1 wherein said dihydroxybenzene compound is 4-tert-butylresorcinol.

* * * * *